United States Patent [19]

Brecht

[11] Patent Number: 4,521,137

[45] Date of Patent: Jun. 4, 1985

[54] MOVABLE CASING FOR THE EXCAVATION OF TRENCHES

[76] Inventor: Maria Brecht, Grosse Rheinstrasse 99, Philippsburg, Fed. Rep. of Germany, 7522

[21] Appl. No.: 518,345

[22] Filed: Jul. 29, 1983

[30] Foreign Application Priority Data

Dec. 20, 1982 [DE] Fed. Rep. of Germany ..... 3234440

[51] Int. Cl.[3] ..... E02D 17/08

[52] U.S. Cl. ..... 405/283; 405/272; 405/282

[58] Field of Search ..... 405/282, 283, 272, 145; 37/80 R, 80 A

[56] References Cited

U.S. PATENT DOCUMENTS

| | | | |
|---|---|---|---|
| 3,693,358 | 9/1972 | Morrice | 405/283 |
| 3,813,886 | 6/1974 | Alacchi | 405/296 |
| 3,820,345 | 6/1974 | Brecht | 405/283 |
| 3,967,454 | 7/1976 | Barnes | 405/282 |
| 4,063,425 | 12/1977 | Jutte et al. | 405/145 |
| 4,073,151 | 2/1978 | Harmsma | 405/301 |
| 4,143,519 | 3/1979 | Unger | 405/145 |

*Primary Examiner*—Dennis L. Taylor

*Attorney, Agent, or Firm*—Klaus J. Bach

[57] ABSTRACT

A trenching casing for the continuous excavation and refilling of trenches for the installation of conduits into the ground has spaced side walls consisting of at least upper and lower sections which are longitudinally movably relative to each other and each of which has a rear face plate with a hydraulic advancing cylinder for pushing the respective section forwardly, and the upper and lower sections are interconnected by hydraulic operating cylinders which facilitate the advancing of one of the sections relative to, and guided by, the other section which, meanwhile, remains in a firm position.

10 Claims, 3 Drawing Figures

MOVABLE CASING FOR THE EXCAVATION OF TRENCHES

FIELD OF THE INVENTION

The invention relates to a movable trenching casing adapted to be lowered into the ground for the continuous construction of trenches. The casing wall structure consists of two spaced retaining walls disposed at a distance from one another corresponding to the desired width of the trench to be built. The casing has rear face plates with hydraulic actuating pistons and cylinders associated therewith for forcing the face plates against the fill material deposited behind the casing for advancing the casing.

BACKGROUND OF THE INVENTION

In casing structures known in the art (DE Pat. No. 2,135,577) the casing wall sections are interconnected after being introduced into a trench so that the opposite casing walls each are unitary pieces. Between the opposite casing walls which are braced against on another pipes or tubes etc. may be lowered into the trench. Soil is removed in front of the casing and dumped into the trench behind the casing. After a sufficient amount of soil is dug out in front of the casing, the complete casing is advanced by the hydraulic operating pistons and cylinders which act on the face plates in the rear of the casing. After advancement of the casing, a new operating cycle may begin. During the hydraulic advancement, the soil deposited behind the casing is, at the same time, compacted.

It has been found that elaborate equipment is required to prevent the downward movement of the front portion of such casings during operation. Such downward movement is caused by the weight of the casing but also by the resistance experienced at the lower front edge of the casing during its advancement. This generates a torque directing the front part of the casing downwardly since the advancement forces are applied by the rear face plates at a higher level and the resistance forces are generated mainly at the lower end of the casing as at the lower front edge. These forces together produce a torque which forces the front part of the casing downwardly. Furthermore, if the forces required for advancement of the casing through the ground are larger than the ground resistance of the material filled in behind the casing and serving as abutment as it might occur at greater depths and large cutting resistances, then the ground filled-in behind the casing will flow, under high pressure, upwardly along a certain sliding slope depending on the material and, in the process, causes uplifting of the rear end of the casing along with the upwardly flowing soil. Together, all the forces and phenomena cooperate to tilt the casing downwardly in the front and upwardly in the rear.

Counter measures have been developed which include stabilizer foils cutting into the ground and support gears having wheels rolling either on the surface at the sides of the trench or at the bottom of the trench. Stabilizer foils however can be used only if the soil is suitable to be cut, they cannot be utilized when the soil is rocky or includes boulders. Furthermore, they are not very effective. Support gears on the other hand require a relatively large amount of space which is objectionable especially since they need to be placed in the front part of the casing where the space is needed for the digging operation. They also require a soil which provides sufficient support which is not always available. Often support gears cannot be used simply because the space is not available as such casings are generally utilized when little space is available. Sometimes problems arise also by intersecting utility lines which may require installation of auxiliary support means in order to utilize the rear face plates to generate the hydraulic advancing forces for the casing.

It is therefore desirable to provide an arrangement in which during advancement of the casing no torque or forces are generated which cause downward tilting of the front of the casing and which permits advancing of the casing even if the hydraulic advance cylinders acting on the rear face plates cannot or not fully be utilized.

SUMMARY OF THE INVENTION

In a trenching casing for the excavation and refilling of a trench after installation of ducts into the trench with spaced side walls for retaining the ground, the side walls consist of upper and lower sections which are longitudinally movable relative to each other and which are interconnected by hydraulic operating means for moving one section relative to the other. Each section is provided also with a rear face plate supported by hydraulic advancing cylinders mounted on the respective casing section for forcing the rear face plate against the ground filled into the trench behind the casing thereby forcing the respective casing section forward. Hydraulic operating means and advancing cylinders are utilized to alternately advance one of the sections while the other section remains in position so as to guide the one casing section during its advancement.

Unlike in the arrangement according to German Pat. No. 2,135,577 the horizontal sections of the casing are not interconnected to form a unitary structure but are movable lengthwise relative to one another by means of double acting hydraulic cylinders mounted between adjacent sections. This permits successive advancing of the different sections of the casing. If one of the rear face plates cannot be utilized, advancement forces can be applied to one section by means of the double acting hydraulic cylinders. Also by force transmission from one to another section through the double acting hydraulic cylinders the force that can be generated by all rear face plates combined can be concentrated for the advancement of just one of the sections of the casing. Also, height control of the casing during advancement is possible by utilizing the double acting hydraulic cylinders in advancement first the top section of the casing which may easily be controlled to remain level by utilization of the double acting cylinder alone or in combination with the advancing cylinder acting on the rear face plate or the advancing cylinder alone depending on the soil and the position of the casing. Next, the adjacent lower section is advanced guided by the properly positioned upper section with which it is engaged by guide rails. There may be more than one hydraulic cylinder provided between adjacent side wall sections for example a front cylinder and a rear cylinder wherein the front cylinder is connected with its front end to the upper casing section and with its rear end to the lower casing section whereas the rear cylinder is connected with its front end to the lower casing section and with its rear end to the upper casing section so as to permit—in exceptional cases—downward forcing of the lower section while being advanced.

It has been found that, in most cases, the arrangement according to the invention is sufficient to prevent undesired downward movement of the casing. Sometimes however, under very difficult ground conditions, it was found that additional means were needed to avoid downward forces on the casing.

In another embodiment, the double acting hydraulic cylinders are therefore not directly connected between the adjacent sections but are linked to pivot arms which are pivotally supported on the upper section and have their opposite downwardly projecting lower end engaged at a bearing point of the lower casing.

With this arrangement the transmission of tilting forces to the lower casing is avoided especially if the bearing point is disposed near the lower end of the lower casing. In any case the bearing point should be arranged at the lower half of the lower casing preferably about in line with the combined friction forces acting on the lower casing section during advancement so that no torque forces are generated in the lower casing during advancement thereof. If the bearing point for the pivot arm is selected even lower, then a torque may be generated which tends to lift the front end and depresses the rear end of the casing.

It is therefore possible to control the advancement of the casing for the desired traveling height. It is noted that two or more such pivot arms may be used to interconnect adjacent casing sections and more than one hydraulic cylinder may be utilized in connection with each such pivot arm.

SHORT DESCRIPTION OF THE DRAWINGS

DESCRIPTION OF THE PREFERRED EMBODIMENT

Figure 1:
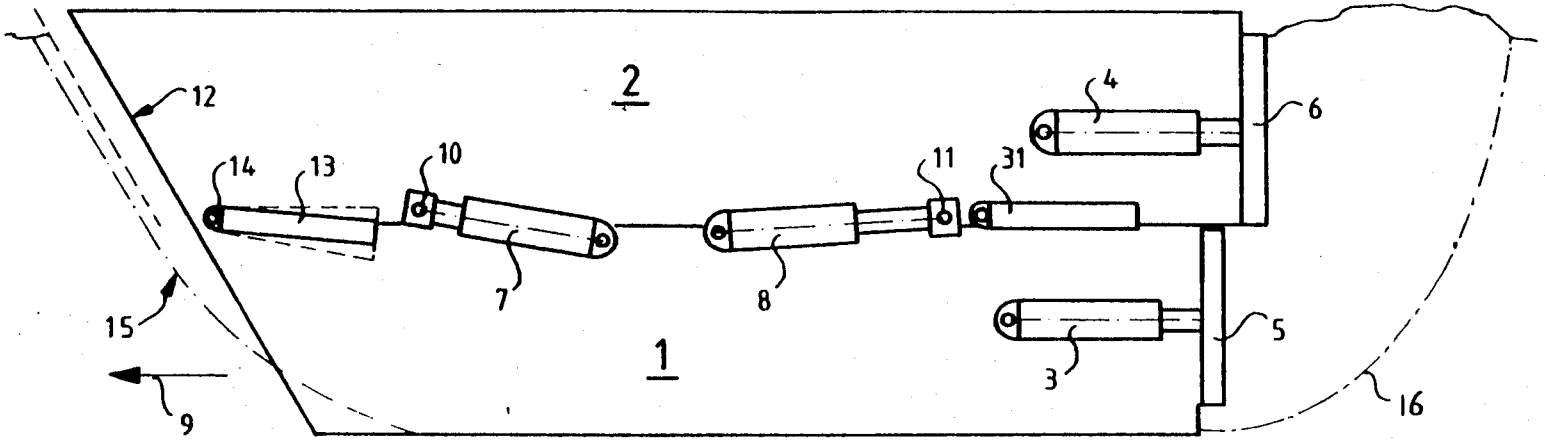
FIG. 1 is a side view from within a casing having two sections disposed on top of one another.

FIG. 1 shows a lower casing section 1 with an upper casing section 2 longitudinally movably disposed thereon. At the rear end of the sections 1 and 2 there are provided hydraulic advancing cylinders 3 and 4 which carry rear face plates 5 and 6. Additional hydraulic operating cylinders 7 and 8 are connected between the two casing sections. The—in advancing direction 9—-forward cylinder 7 is linked at its front end 10 to the upper casing section 2 and at its other end to lower casing section 1. The rear operating cylinder 8 is linked with its front end to the lower casing section whereas its rear end 11 is linked to the upper casing section 2.

Near the front edge 12 of the casing there is provided a pivotal guide rail 13 whose angular position about a pivot point 14 is adjustable within a limited range as shown in dashed lines. A similar guide rail 31 is provided at the rear end of the casing sections but this guide rail need not be adjustable. It merely slidably engages the two casing sections 1, 2 with one another so as to prevent separation of the upper section 2 from the lower section 1.

The dash-dotted line 15 at the front edge 12 of the casing indicates the excavating area and the dash-dotted line 16 at the rear of the casing is a sliding curve along which the ground filled into the trench behind the casing and compressed by the rear face plates 5 and 6 might slide upwardly.

Figure 2:
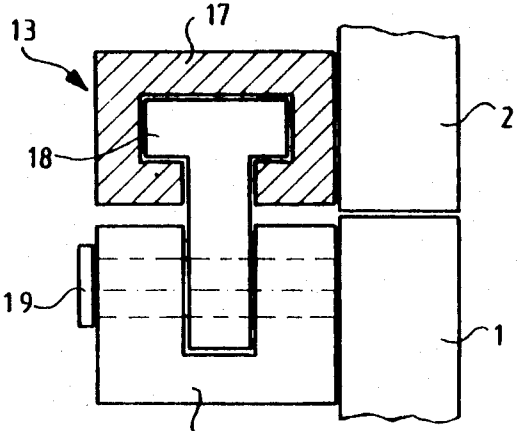
FIG. 2 shows, in cross-section, the guide rails interconnecting the two sections.

FIG. 2 shows, in cross-section, a guide structure 13 which comprises a guide rail 17 and a guide block 18. The guide block 18 is mounted on the lower casing section 1 by means of a removable bolt 19 extending through a mounting block 20 connected to the lower casing section. The guide rail 17 is mounted on the upper casing section by an arrangement that permits adjustment of its angular position.

For advancement of the casing 2, first, the upper hydraulic advancing cylinder 4 may be energized; in addition the hydraulic operating cylinders 7, 8 between the casing sections 1 and 2 may be utilized for applying an advancing force to the upper section 2. During advance of the upper casing section the guide block 18 slides longitudinally on guide rail 17 so that the upper casing section 2 is guided for movement relative to the lower casing section 1 depending on the angular position of the guide structure 13. After advancement of the upper casing section 2 by a certain amount, the lower casing section 1 is brought up to a point where, again, a unitary casing structure is formed as shown in the drawings. During this process, the angular position of the guide structure 13 is selected depending on the ground conditions.

Figure 3:
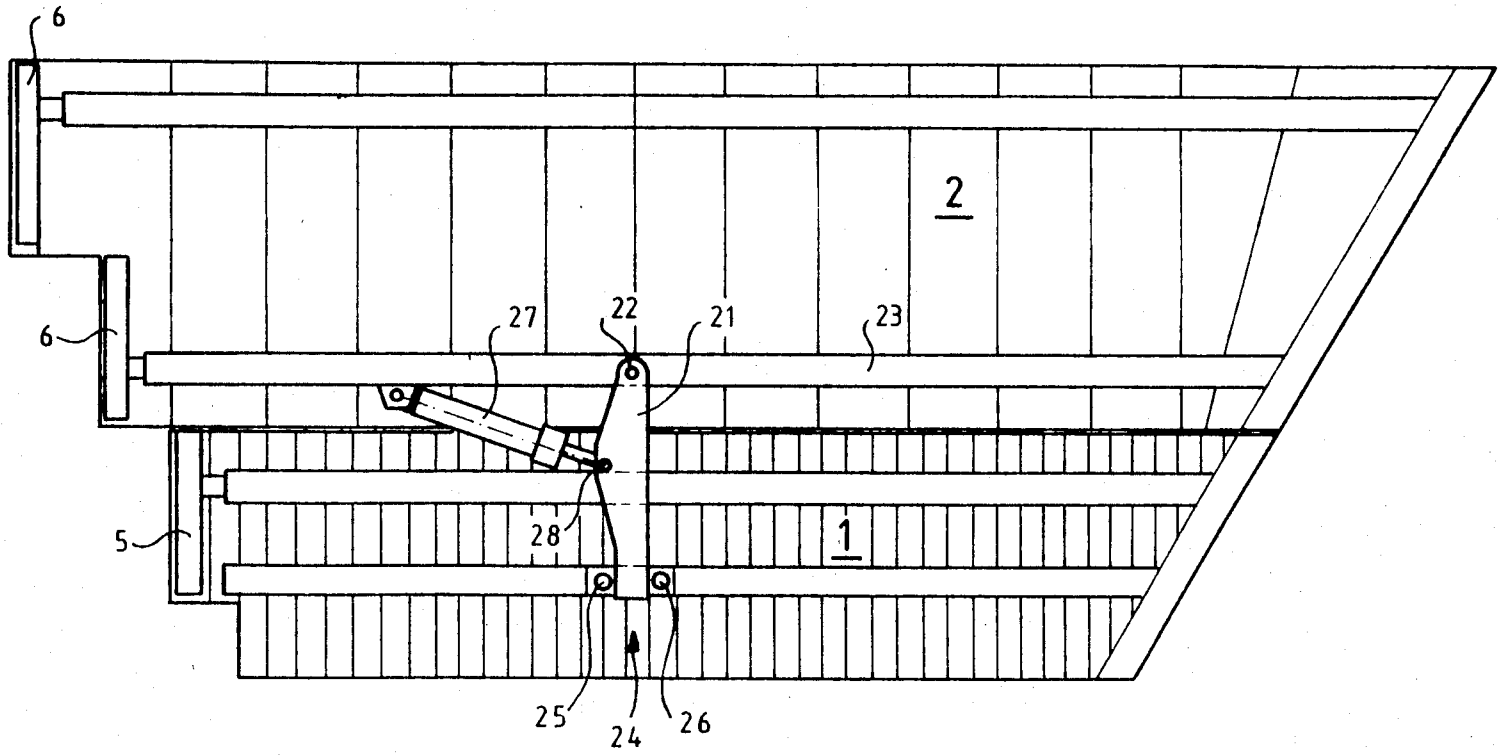
FIG. 3 is a side view of a casing having two sections with a pivot lever connected therebetween.

FIG. 3 finally shows an arrangement wherein an operating cylinder 27 is connected to a pivotal operating lever 21 pivotally supported on a lower support brace 23 of the upper casing 2 by means of a pivot bearing 22. The free lower end of the pivot lever 21 is engaged by a bearing structure 24 consisting of two spaced roller bearings 25, 26 mounted to the lower casing section 1 and receiving the free end of the pivot lever 21 therebetween. About at midlength of the pivotal operating lever 21 the operating cylinder 27 is linked to the pivot lever 21; at its other end the operating cylinder 27 is linked to the lower support brace 23 of the upper casing section 2.

For advancement of the lower casing structure in this arrangement, the hydraulic operating cylinder 27, when energized, forces the pivotal operating lever forwardly toward the front end (right side in FIG. 3) of the casing so that the pivotal operating lever moves the lower casing section forwardly by a force applied thereto through the bearing structure 24 while the rear face plate or plates 6 bear against the fill behind the casing. Since, in this case, the forward force is applied at a low location, that is below the horizontal center of the lower casing section 1, there is no torque which tends to move the front end of the lower casing section downwardly.

After advancement of the lower casing section 1, the upper casing section 2 may be advanced by energizing the double acting hydraulic cylinder 27. It is also possible of course to advance first the upper casing section 2 and then the lower casing section 1. The alternate advancing of the casing sections 1, 2 may of course always be aided by utilizing the hydraulic advancing cylinders 3, 4 in connection with the rear face plates 5, 6.

I claim:

1. A trenching casing for the continuously advancing excavation and refilling of trenches for the installation of ducts, said casing having spaced side walls consisting of at least two vertically adjacent sections, engaging means for supporting said sections movably relative to one another, at least one rear face plate supported—in the advancing direction—at the rear end of each casing section, essentially horizontal hydraulic cylinders mounted on each casing section and connected to the respective rear face plate for forcing said rear face plate against the ground behind the casing and hydraulic operating means extending between and having one end operatively connected to one and the other end to the other of said vertically adjacent casing sections for transmitting an advancing force between said sections for longitudinally moving one of the two adjacent casing sections while the other remains in position and provides the backup for the advancing force applied to said one section.

2. A casing according to claim 1, wherein two hydraulic operating cylinders are arranged behind one another along adjacent casing wall sections and the—in advancing direction—forward cylinder is hinged with its front end to the upper casing section and with its rear end to the lower casing section whereas the—in advancing direction—rear cylinder is hinged with its front end to the lower casing section and with its rear end to the upper casing section.

3. A casing according to claim 2, wherein a front slide guide structure is provided at the front end of said casing sections, which extends essentially parallel to said forward operating cylinder, and a rear guide structure is provided near the rear end of said casing and extending essentially parallel to the longitudinal extension of said casing sections, each said guide structure including a guide rail supported by one casing section and slidably engaging a guide block mounted on the other of two adjacent casing sections.

4. A casing according to claim 3, wherein the guide rail of said front guide structure is pivotally supported on the respective one of said adjacent casing sections and is angularly adjustable.

5. In a trenching casing for the continuously advancing excavation and refilling of trenches for the installation of ducts, said casing having spaced side walls consisting of at least two adjacent sections, engaging means for supporting said sections movably relative to one another, at least one rear face plate supported—in the advancing direction—at the rear end of each casing section, essentially horizontal hydraulic cylinders mounted on each casing section and connected to said rear face plate for forcing said rear face plate against the ground behind the casing, the improvement wherein at least one pivotal operating arm is linked to the upper of two adjacent casing sections and has a lower end engaged by a bearing structure mounted on the lower of the two adjacent casing sections, at least one of said hydraulic operating cylinders being connected to said pivotal operating arm for linking said operating cylinder with said lower casing section.

6. A casing according to claim 5, wherein said hydraulic operating cylinder is connected to said pivotal operating arm at a point between the pivot point of said pivotal operating arm and at its lower end is engaged by said bearing structure.

7. A casing according to claim 5, wherein said bearing structure for the lower end of said pivotal operating arm is arranged in the lower half of the lower casing section.

8. A casing according to claim 5, wherein said bearing structure consists of two spaced support rollers engaging therebetween the lower end of said pivotal operating arm.

9. A casing according to claim 5, wherein a front slide guide structure is provided at the front end of said casing sections, which extends essentially parallel to said forward operating cylinder, and a rear guide structure is provided near the rear end of said casing and extending essentially parallel to the longitudinal extension of said casing sections, each said guide structure including a guide rail supported by one casing section and slidably engaging a guide block mounted on the other of two adjacent casing sections.

10. A casing according to claim 9, wherein the guide rail of said front guide structure is pivotally supported on the respective one of said adjacent casing sections and is angularly adjustable.

* * * * *